US010224679B1

(12) United States Patent
Chen et al.

(10) Patent No.: US 10,224,679 B1
(45) Date of Patent: Mar. 5, 2019

(54) ADAPTER AND ADAPTER MODULE HAVING THE SAME

(71) Applicant: CYBER POWER SYSTEMS, INC., Taipei (TW)

(72) Inventors: Yu-Jen Chen, Taipei (TW); Cheng-Yen Lo, Taipei (TW); Hsiung-Kuei Cheng, Taipei (TW)

(73) Assignee: CYBER POWER SYSTEMS, INC., Taipei (TW)

( * ) Notice: Subject to any disclaimer, the term of this patent is extended or adjusted under 35 U.S.C. 154(b) by 0 days.

(21) Appl. No.: 15/787,123

(22) Filed: Oct. 18, 2017

(30) Foreign Application Priority Data

Sep. 1, 2017 (CN) ..... 2017 1 0777451

(51) Int. Cl.
*H01R 13/66* (2006.01)
*H01R 31/06* (2006.01)

(52) U.S. Cl.
CPC ..... *H01R 13/6691* (2013.01); *H01R 13/6675* (2013.01); *H01R 13/6683* (2013.01); *H01R 31/065* (2013.01)

(58) Field of Classification Search
CPC ..... H01R 2107/00; H01R 13/6683; H01R 13/6205; H01R 24/64; H01R 31/065; H01R 24/60; H01R 13/6691; H01R 25/00; H01R 13/642; H01R 2201/06; H01R 13/516; H01R 24/28; H01R 27/02; H01R 31/06
See application file for complete search history.

(56) References Cited

U.S. PATENT DOCUMENTS

2005/0063116 A1* 3/2005 Rotheroe ..... G01R 19/2513 361/90
2007/0149013 A1* 6/2007 Eastham ..... H01R 13/7036 439/140
2010/0283330 A1* 11/2010 Lanni ..... H02J 1/00 307/149
2011/0012661 A1* 1/2011 Binder ..... A63F 9/24 327/276
2014/0075061 A1* 3/2014 Fritchman ..... G06F 1/1632 710/62
2014/0087585 A1* 3/2014 Anastas ..... H01R 13/641 439/489
2016/0254628 A1* 9/2016 Liao ..... H01R 27/02 439/535
2017/0062993 A1* 3/2017 Sumner ..... B60L 11/1818
(Continued)

*Primary Examiner* — Truc Nguyen
(74) *Attorney, Agent, or Firm* — Bacon & Thomas, PLLC

(57) ABSTRACT

An adapter module including an adapter and a power cord is provided. The adapter includes a first interface, at least a second interface coupled with at least a load, an identifying circuit having a sensing switch configured at the first interface, a controller, and a detecting circuit. The first interface is provided for inserting by a connector of the power cord. The sensing switch changes its on/off state depending on whether the first connector provides a trigger. A first message is generated if the first connector provides the trigger. The controller is coupled to the identifying circuit and receives the first message. The detecting circuit is coupled between the first interface and the second interface for detecting a power parameter value, and provides a second message to the controller. The controller sends a warning message according to the first message and the second message.

20 Claims, 2 Drawing Sheets

(56) References Cited

U.S. PATENT DOCUMENTS

| | | | | |
|---|---|---|---|---|
| 2017/0201050 | A1* | 7/2017 | Akita | H01B 11/00 |
| 2017/0222459 | A1* | 8/2017 | Kang | H01R 31/065 |
| 2017/0264115 | A1* | 9/2017 | Bencuya | H02J 7/0045 |
| 2017/0324195 | A1* | 11/2017 | Eriksen | H01R 13/6666 |
| 2017/0358922 | A1* | 12/2017 | Bacon | H02H 9/04 |
| 2018/0034224 | A1* | 2/2018 | Chung | G06F 13/4068 |

* cited by examiner

10

ADAPTER AND ADAPTER MODULE HAVING THE SAME

BACKGROUND OF THE INVENTION

Field of the Invention

The present invention relates to an adapter and an adapter module, and more particularly, the present invention is relates to an adapter and an adapter module with identifying function of power cord for sending a warning message.

Description of Related Art

With the development of technology, a large number of electrical equipments are used in life. Plugs of these electrical equipments can insert into an adapter for coupling to utility power through a power cord of the adapter. However, excessive electrical equipments coupled to the adapter may cause the power cord to be overloaded. Especially, when the user selects the power cord which is not special to the adapter, the power cord may be more likely to be dangerous due to the lower safety of the power cord, reducing the safety of electricity.

SUMMARY OF THE INVENTION

Accordingly, an object of the present invention is to provide an adapter and an adapter module which can upgrade the safety of electricity by the identifying function of power cord for sending a warning message.

To achieve the foregoing and other objects, an adapter is provided. The adapter is suitable for coupling to a power cord having a first connector. The he adapter includes a first interface, at least a second interface, an identifying circuit, a controller and a detecting circuit. The first interface is provided for inserting by the first connector of the power cord. Theses second interfaces are suitable for coupling with at least a load. The identifying circuit has a sensing switch. The sensing switch is configured at the first interface, and the sensing switch changes its on/off state depending on whether the first connector provides a trigger, and a first message is generated if the first connector provides the trigger. The controller is coupled to the identifying circuit and receives the first message. The detecting circuit is coupled between the first interface and the second interface to detect the power parameter value between the first interface and the second interface for providing a second message to the controller. Wherein, the controller sends a warning message according to the first message and the second message.

In one embodiment of the present invention, the first connector is configured with a trigger element, when the first connector inserts into the first interface, the sensing switch changes its on/off state according to the trigger the trigger element.

In one embodiment of the present invention, the sensing switch is a reed switch and the trigger element is a magnetic element, when the first connector inserts into the first interface, the reed switch changes its on/off state according to the trigger the magnetic element.

In one embodiment of the present invention, the type or specification of the power cord is defined by the configuration of the trigger element.

In one embodiment of the present invention, the first message includes that whether the first connector provides the trigger so that the controller defines a rated current value corresponding to the power cord, and the second message includes a actual current value between the first interface and the second interface, the controller sends the warning message when the actual current value is greater than or equal to the rated current value.

In one embodiment of the present invention, the rated current value of the power cord is defined by the controller according to the on/off state of the sensing switch.

In one embodiment of the present invention, the adapter further includes a reminding unit, coupled with the controller and receives the warning message.

In one embodiment of the present invention, the adapter further includes a switching unit, coupled between the first interface and the detecting circuit, and the controller controls the on/off state of the switching unit according to the first message and the second message.

In one embodiment of the present invention, the adapter further includes a battery, coupled between the switching unit and the second interface, the controller controls the battery to power the load when the switching unit is off.

In one embodiment of the present invention, the adapter further includes a circuit board, a third interface and a power unit, the controller, the third interface and the power unit are configured at the circuit board, wherein the sensing switch is coupled to the third interface, and the power unit powers the sensing switch through the third interface, and the controller couples to the identifying circuit through the third interface.

An adapter module is further provided in the present invention. The adapter module includes the abovementioned adapter and a power cord. Wherein, the power cord has a first connector which is suitable for inserting into the first interface of the adapter.

BRIEF DESCRIPTION OF THE DRAWINGS

Other features and advantages of the present invention will become apparent in the following detailed description of the preferred embodiments with reference to the accompanying drawings, of which.

DESCRIPTION OF EMBODIMENTS

The characteristics, contents, advantages and achieved effects of the present disclosure will become more fully understood from the detailed description given herein below and the accompanying drawings which are given by way of illustration only, and thus are not limitative of the present disclosure.

As required, detailed embodiments are disclosed herein. It must be understood that the disclosed embodiments are merely exemplary of and may be embodied in various and alternative foams, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods that are known to those having ordinary skill in the art have not been described in detail in order to avoid obscuring the present disclosure. Therefore, specific structural and functional details disclosed herein are not to be interpreted as limiting, but merely as a basis for the claims and as a representative basis for teaching one skilled in the art.

Figure 1:
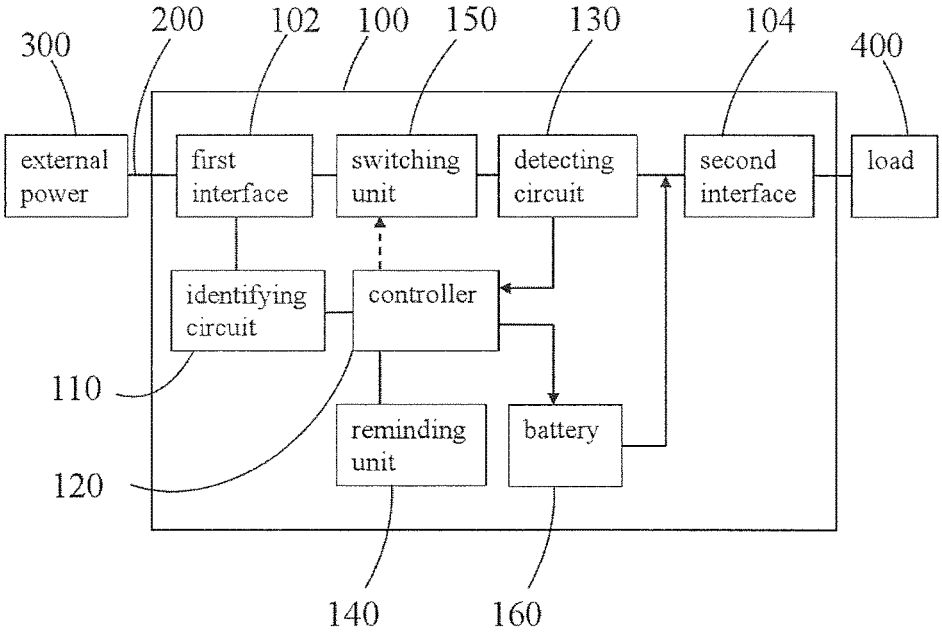
FIG. 1 is a block diagram showing an adapter according to one embodiment of the present invention.
Figure 2:
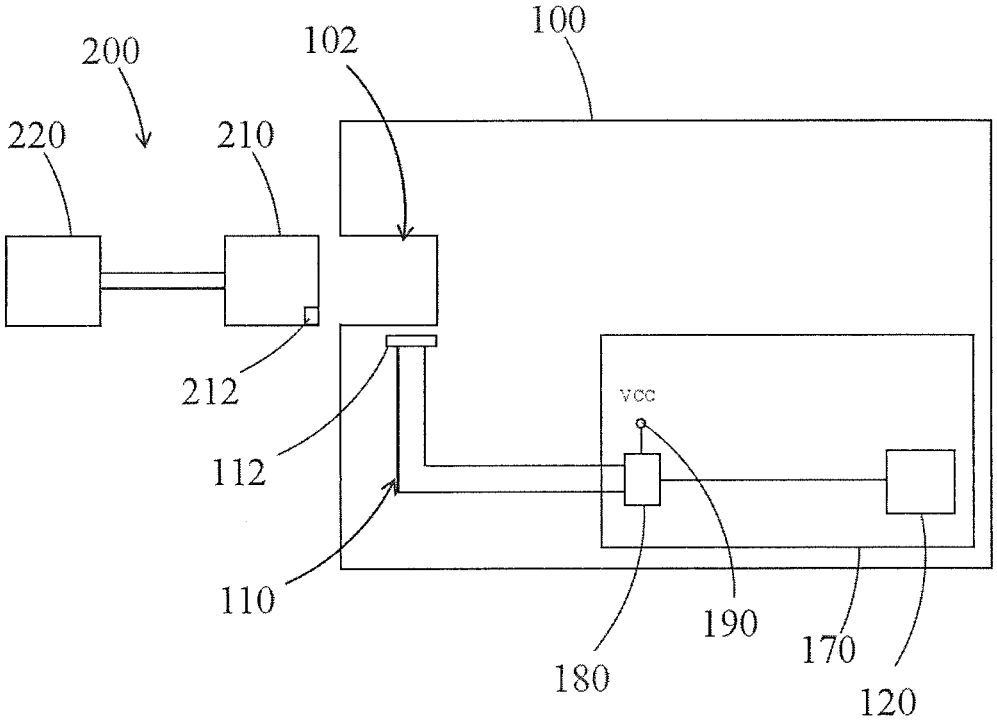
FIG. 2 is a schematic diagram showing an adapter module according to one embodiment of the present invention.

FIG. 1 is a block diagram showing an adapter according to one embodiment of the present invention. FIG. 2 is a schematic diagram showing an adapter module according to one embodiment of the present invention. Referring to FIG. 1 and FIG. 2, an adapter module 10 of the present embodiment is, for example, a power strip. The adapter module 10 of the present embodiment includes an adapter 100 and a power cord 200 mainly. The adapter 100 is suitable for coupling with the power cord 200. In the present embodiment, the power cord 200 has a first connector 210 and a second connector 220. The first connector 210 is suitable for coupling with the adapter 100. The first connector 210 is suitable for configuring with a trigger element 212. Besides, the second connector 220 is suitable for coupling to the external power 300. The external power 300 is, for example, a utility power. In addition, the adapter 100 of the present embodiment includes a first interface 102, at least a second interface 104, an identifying circuit 110, a controller 120 and a detecting circuit 130 mainly.

Wherein, FIG. 2 presents the configuring relationship between the power cord 200 of the adapter module 10, the identifying circuit 110 and the controller 120 mainly, and other elements are not shown in FIG. 2. In addition, the power cord 200 is exemplified as a special power cord for the adapter 100. Besides, first interface 102 is, for example, the input port of the adapter 100. The second interface 104 is, for example, the output port of the adapter 100. The amount of the second interface 104 illustrating in FIG. 1 is just one, and it is not limited in the invention.

From above, in the present embodiment, the first interface 102 can be inserted for the first connector 210 of the power cord 200. These second interfaces 104 are suitable for coupling with at least a load 400. The loads 400 are, for example, various electrical devices or electrical equipments, and it is not limited in the invention. In addition, the amount of the load 400 illustrating in FIG. 1 is also just one, and it is not limited in the invention. Besides, the identifying circuit 110 of the present embodiment has a sensing switch 112. Wherein, the sensing switch 112 is configured at first interface 102. Worth mention, in the present embodiment, the sensing switch 112 changes its on/off state depending on whether the first connector 210 provides a trigger, and then a first message is generated correspondingly. Further, the first connector 210 of the present embodiment can be configured with the trigger element 212. When the first connector 210 inserts in the first interface 102, the sensing switch 112 configured at the first interface 102 can be triggered by the trigger element 212 for changing its on/off state. For example, the sensing switch 112 configured at first interface 102 can be turned on by the trigger from the trigger element 212.

In one preferred embodiment, the sensing switch 112 is a reed switch, and the trigger element 212 is a magnetic element. Thus, when the first connector 210 inserts into the first interface 102, the reed switch can be triggered by the magnetic element, and changes its on/off state. For example, when the first connector 210 inserts into the first interface 102, the reed switch can be turned on. In other preferred embodiments, the trigger element 212 can be a protruding structure configured at the first connector 210, and the sensing switch 112 can be a pressing structure configured inside of the first interface 102. Thus, when the first connector 210 inserts into the first interface 102, the pressing structure configured inside of the first interface 102 can be pressed by effect of protruding structure configured at the first connector 210 substantially. When the sensing switch 112 is pressed by the trigger of substantial press, the sensing switch 112 can change its on/off state. For example, when the first connector 210 inserts into the first interface 102, the sensing switch 112 is in "on" state. In other words, the trigger from the trigger element 212 is, for example, a non-contact trigger or a touch trigger, and it is not limited in the invention.

In the above embodiment, the configuration of the trigger element 212 is used to define the type or the specification of the power cord 200. In detail, the power cord 200 configured with the trigger element 212 is, for example, a special power cord of the adapter 100 of the present invention having a preferred safety. Relatively, the power cord without having the trigger element is, for example, the power cord sold in the market, which is unable to meet the safe require of the adapter 100 in use. In other words, the present invention can define the type, the specification or safety in use of the power cord by the configuration of the trigger element 212.

On the other hand, the controller 120 of the present embodiment can be coupled with the identifying circuit 110, and receives the first message. Besides, the detecting circuit 130 is coupled between the first interface 102 and the second interface 104. The detecting circuit 130 can detect a power parameter value between the first interface 102 and the second interface 104, and provides a second message to the controller 120. Wherein, the power parameter value is, for example, a current value. In the present embodiment, the first message includes that, for example, whether the first connector 210 provides the trigger and the second message includes an actual current value between the first interface 102 and the second interface 104.

Worth mention, the controller 120 of the present embodiment can define a rated current value (rated current) of the power cord 200 inserted in the first interface 102 depending on whether the first connector 210 provides the trigger. In detail, the controller 120 defines the rated current value corresponding to the power cord 200 according to the on/off state of the sensing switch 112. Further, when the actual current value is greater than or equal to the rated current value, the controller 120 can send a warning message. In other words, the controller 120 of the present embodiment can sends the warning message according to the received first message and second message. The on/off state of the sensing switch 112 is, for example, "on" or "off" state.

For example, the corresponding rated current value of the power cord 200 configured with the trigger element 212 can be 20 A, and the overall load of the adapter module 10 can be 2000 VA. Relatively, the load abilities of various power cords without having the trigger element 212 are different. Based on safety, the controller 120 of the present embodiment defines the load ability of power cord without having the trigger element 212 is less than the load ability of the foregoing power cord 200 directly. For example, the corresponding rated current value of the power cord without having the trigger element 212 is 15 A. Thus, in the condition that the adapter 100 is used with the power cord without having the trigger element 212, if the second interfaces 104 of the adapter 100 are plugged with excessive loads for resulting the actual current value between the first interface 102 and the second interface 104 equivalent or over 15 A (rated current value), the controller 120 will sends the warning message.

In the present embodiment, the adapter 100 includes, for example, a reminding unit 140. The reminding unit 140 is, for example, a warning device. The reminding unit 140 can be coupled with the controller 120, and receives the warning message. Thus, when the actual current value greater than or equal to the rated current value, the controller 120 can sends, for example, a sound warning or a light warning through the reminding unit 140 for making users to take note of safety in use.

Further, in order to make the adapter module 10 of the present embodiment have a preferred safety in use, the adapter 100 of the present embodiment further includes a switching unit 150. The switching unit 150 of the present embodiment is coupled between the first interface 102 and the detecting circuit 130. Thus, the controller 120 can control the on/off state of the switching unit 150 according to the first message and the second message. Simply, when the controller 120 determines the actual current value greater than or equal to the rated current value, the controller 120 also can control the switching unit 150 to be off for making the external power 300 stop to power for the load 400 except sending the warning message through the reminding unit 140. Even, the controller 120 of the adapter 100 can lowered the rated output current of the second interface 104. For example, the rated output current of the second interface 104 can be lowered to 15 A from 20 A. Thus, the present embodiment can ensure the safety of the power cord in use, and prevent dangers resulted by lacking the loading ability of power cord without having the trigger element 212. The on/off state of the switching unit 150 is, for example, "on" or "off" state.

In addition, the adapter 100 of the present embodiment further includes a battery 160. The battery 160 is coupled between the switching unit 150 and the second interface 104. Thus, when the switching unit 150 is in "off" state, the controller 120 can control the battery 160 to power for the load 400. Therefore, when the external power 300 stops powering for the load 400, the load 400 still can be work through the battery 160.

Besides, the adapter 100 of the present embodiment also further includes a circuit board 170, a third interface 180 and a power unit 190. The controller 120, the third interface 180 and the power unit 190 are, for example, configured at the circuit board 170. Wherein, the sensing switch 112 is coupled to the third interface 180. The sensing switch 112 can be powered by the power unit 190 through the third interface 180. The controller 120 is coupled to the identifying circuit 110 through the third interface 180. In the present embodiment, the power unit 190 is, for example, is a separated power component. Thus, the sensing switch 112 can sense continuously whether the first connector 210 of the power cord is configured with the trigger element 212. Further, the controller can determine effectively whether the power cord has enough loading ability for powering the load 400. Certainly, in one preferred embodiment, the sensing switch 112 also can be powered by the external power 300 through the first interface 102 directly, and it is not limited in the invention.

To sum up, in the present invention, a trigger element can be configured in the special power cord of the adapter so that the adapter of the present invention can sense effectively whether the power cord inserted therein is the special specification for the adapter of the present invention. Further, the present invention can determine whether the power cord has enough loading ability for powering the load. If the power cord does not have enough loading ability for powering the load, the adapter of the present invention can send the warning message for reminding users. Certainly, the present invention also can make the external power stop to power for the load through the configuration of the switching unit. In other words, the adapter module of the present invention has a preferred safety in use.

While the disclosure has been described by way of example and in terms of the preferred embodiments, it is to be understood that the disclosure is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An adapter, suitable for coupling to a power cord having a first connector, comprising:

a first interface, provided for inserting by the first connector of the power cord;

at least a second interface, suitable for coupling with at least a load;

an identifying circuit, having a sensing switch and being configured at the first interface, and the sensing switch changes its on/off state depending on whether the first connector provides a trigger, and a first message is generated if the first connector provides the trigger;

a controller, coupled to the identifying circuit, and receives the first message; and a detecting circuit, coupled between the first interface and the second interface for detecting a power parameter value between the first interface and the second interface, and provides a second message to the controller;

wherein, the controller sends a warning message according to the first message and the second message.

2. The adapter according to claim 1, wherein the first connector is configured with a trigger element, when the first connector inserts into the first interface, the sensing switch changes its on/off state according to the trigger element.

3. The adapter according to claim 2, wherein the sensing switch is a reed switch and the trigger element is a magnetic element, when the first connector inserts into the first interface, the reed switch changes its on/off state according to the magnetic element.

4. The adapter according to claim 2, wherein the type or specification of the power cord is defined by the configuration of the trigger element.

5. The adapter according to claim 1, wherein the first message includes that whether the first connector provides the trigger so that the controller defines a rated current value corresponding to the power cord, and the second message includes an actual current value between the first interface and the second interface, the controller sends the warning message when the actual current value is greater than or equal to the rated current value.

6. The adapter according to claim 5, wherein the rated current value of the power cord is defined by the controller according to the on/off state of the sensing switch.

7. The adapter according to claim 1, further comprising a reminding unit, coupled with the controller and receives the warning message.

8. The adapter according to claim 1, further comprising a switching unit, coupled between the first interface and the detecting circuit, and the controller controls the on/off state of the switching unit according to the first message and the second message.

9. The adapter according to claim 8, further comprising a battery, coupled between the switching unit and the second interface, the controller controls the battery to power the load when the switching unit is off.

10. The adapter according to claim 1, further comprising a circuit board, a third interface and a power unit, the controller, the third interface and the power unit are configured at the circuit board, wherein the sensing switch is coupled to the third interface, and the power unit powers the sensing switch through the third interface, and the controller couples to the identifying circuit through the third interface.

11. An adapter module, comprising:

a power cord, having a first connector, an adapter, comprising:

a first interface, provided for inserting by the first connector of the power cord;

at least a second interface, suitable for coupling with at least a load;

an identifying circuit, having a sensing switch and being configured at the first interface, and the sensing switch changes its on/off state depending on whether the first connector provides a trigger, and a first message is generated if the first connector provides the trigger;

a controller, coupled to the identifying circuit, and receives the first message; and a detecting circuit, coupled between the first interface and the second interface for detecting a power parameter value between the first interface and the second interface, and provides a second message to the controller;

wherein, the controller sends a warning message according to the first message and the second message.

12. The adapter module according to claim 11, wherein the first connector is configured with a trigger element, when the first connector inserts into the first interface, the sensing switch changes its on/off state according to the trigger element.

13. The adapter module according to claim 12, wherein the sensing switch is a reed switch and the trigger element is a magnetic element, when the first connector inserts into the first interface, the reed switch changes its on/off state according to the magnetic element.

14. The adapter module according to claim 12, wherein the type or specification of the power cord is defined by the configuration of the trigger element.

15. The adapter module according to claim 11, wherein the first message includes that whether the first connector provides the trigger so that the controller defines a rated current value corresponding to the power cord, and the second message includes an actual current value between the first interface and the second interface, the controller sends the warning message when the actual current value is greater than or equal to the rated current value.

16. The adapter module according to claim 15, wherein the rated current value of the power cord is defined by the controller according to the on/off state of the sensing switch.

17. The adapter module according to claim 11, wherein the adapter further includes a reminding unit, coupled with the controller and receives the warning message.

18. The adapter module according to claim 11, wherein the adapter further includes a switching unit, coupled between the first interface and the detecting circuit, and the controller controls the on/off state of the switching unit according to the first message and the second message.

19. The adapter module according to claim 18, wherein the adapter further includes a battery, coupled between the switching unit and the second interface, the controller controls the battery to power the load when the switching unit is off.

20. The adapter module according to claim 11, wherein the adapter further includes a circuit board, a third interface and a power unit, the controller, the third interface and the power unit are configured at the circuit board, wherein the sensing switch is coupled to the third interface, and the power unit powers the sensing switch through the third interface, and the controller couples to the identifying circuit through the third interface.

* * * * *